US006863913B1

(12) United States Patent
Navin et al.

(10) Patent No.: US 6,863,913 B1
(45) Date of Patent: Mar. 8, 2005

(54) FOOD PREPARATION PROCESS USING BULK DENSITY FEEDBACK

(75) Inventors: James P. Navin, Burlington, WI (US); Ronald L. Fojtik, Racine, WI (US)

(73) Assignee: Spee-Dee Packaging Machinery, Inc., Sturtevant, WI (US)

( * ) Notice: Subject to any disclaimer, the term of this patent is extended or adjusted under 35 U.S.C. 154(b) by 179 days.

(21) Appl. No.: 10/291,105

(22) Filed: Nov. 8, 2002

Related U.S. Application Data

(60) Provisional application No. 60/345,972, filed on Nov. 9, 2001.

(51) Int. Cl.[7] ..... B65B 1/20

(52) U.S. Cl. ..... 426/231; 141/83; 141/98; 141/102; 141/105; 222/77; 222/192; 426/232

(58) Field of Search ..... 426/231, 232; 141/83, 98, 102, 105, 346, 383; 222/77, 192, 370

(56) References Cited

U.S. PATENT DOCUMENTS 3,430,751 A * 3/1969 Bateson ..... 122/55
4,844,937 A 7/1989 Wilkinson et al.
5,018,960 A 5/1991 Singer
5,182,127 A 1/1993 Schwab et al.
5,457,303 A 10/1995 Shute et al.
5,510,130 A 4/1996 Holtz et al.
5,709,902 A 1/1998 Bartolomei et al.
5,919,503 A 7/1999 Leusner
6,273,153 B1 * 8/2001 Reinsch ..... 141/346

OTHER PUBLICATIONS

U.S. Appl. No. 10/062,966 filed Jan. 31, 2002 for "Apparatus for Metering and Packaging Bulk Particulate Material"; Inv.: David J. Hill, now U.S. patent No. 6,612,347.

* cited by examiner

*Primary Examiner*—George C. Yeung
(74) *Attorney, Agent, or Firm*—Boyle Fredrickson Newholm Stein & Gratz S.C.

(57) ABSTRACT

A method and system for food preparation and processing that determines the bulk density of food particulate matter input into particulate packaging machinery and performs bulk density feedback of packaged food particulate matter. The feedback mechanism inputs bulk density values into a controller that are referred against acceptable values. Where the input values of bulk density are outside the acceptable range the controller automatically alters the food preparation and packaging process to obtain acceptable bulk density values. The method system are applicable to any food manufacturing process, although they are particularly well suited to the manufacture of food in flake, chip, puffed or extruded form.

21 Claims, 11 Drawing Sheets

FOOD PREPARATION PROCESS USING BULK DENSITY FEEDBACK

This application claims benefit of provisional patent application No. 60/345,972 filed Nov. 9, 2001.

FIELD OF THE INVENTION

The invention relates generally to food processing machinery and to electronic controllers for controlling such machinery. More particularly, it relates to machinery for producing flaked or particulate material such as breakfast cereals, cookies, baked goods, snack food, and the like that is divided into portions and packaged as individual portions of a predetermined weight and volume. In addition, it relates to machinery for volumetrically measuring individual package portions of such food products and weighing such portions.

BACKGROUND OF THE INVENTION

Many food products, such as those mentioned above, are individually packaged for sale on grocery store shelves. The packages have a finite volume typically on the order of 250 cubic inches and a finite weight, typically on the order of one-half to three pounds. For obvious reasons, manufacturers would like to maintain the weight of the product as closely as possible to the weight designated on the outside of the individual package or box. Underweight products violate federal packaging and marketing standards. At the same time, manufacturers cannot guarantee the minimum weight of food simply by providing an excess volume of food product. Boxes in which the food product is placed have a finite volume, and an excess volume may cause the boxes to distend outwardly, tearing them, or making it difficult or impossible to package them into cartons or containers for shipping.

Further complicating the processes of appropriately portioning the food product is the fact that the food product manufacturing process itself may cause the relationship between volume and weight to vary widely. The relationship between volume and weight is called the "bulk density". Bulk density is expressed as units of weight per units of volume. Typically, it is expressed as ounces per cubic inch or grams per cubic centimeter, although these units of measure are not mandatory. If the bulk density of a food product increases dramatically as food processing equipment drifts from its nominal and preferred position, a unit of weight of the food product will take up a considerably smaller volume. While this is enough to meet federal and state packaging standards, since the weight is held constant, consumers are often upset because the large package they have only appears to be half full. Even though the weight is correct, the reduced volume leaves the consumer feeling angry and frustrated. Similarly, if the bulk density of the food product drops dramatically, a given weight of the product will take up a considerably larger volume. When this happens, if the portioning process for each of the packages is based solely upon weight, the portions will increase in volume and may jam the packaging machinery causing it to fail. This requires shutting down the packaging machinery and cleaning it out. Any shut-down of the food processing line imposes a significant cost on the food manufacturer. What is needed, therefore is a system and process for feeding back a signal indicative of the bulk density of the product being portioned and packaged to the food manufacturing process so that it can be adjusted on the fly and the proper bulk density, weight, and volume of each individually wrapped portion can be properly maintained. It is an object of this invention to provide such a system and process.

SUMMARY OF THE INVENTION

The invention can be summarized as a cup filler or other volumetric metering device that is configured to generate an electrical signal that indicates the bulk density of a volumetrically metered portion of particulate food matter. The cup filler is connected to food processing machinery that actually makes the particulate food matter and sends a signal indicative of the bulk density to the food processing machinery to which it is coupled. The food processing machinery includes an electronic controller that is configured to change at least one operational of the machinery itself in response to the received bulk density signal to thereby alter the bulk density of the food product.

DESCRIPTION OF THE DRAWINGS

The present invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1A:
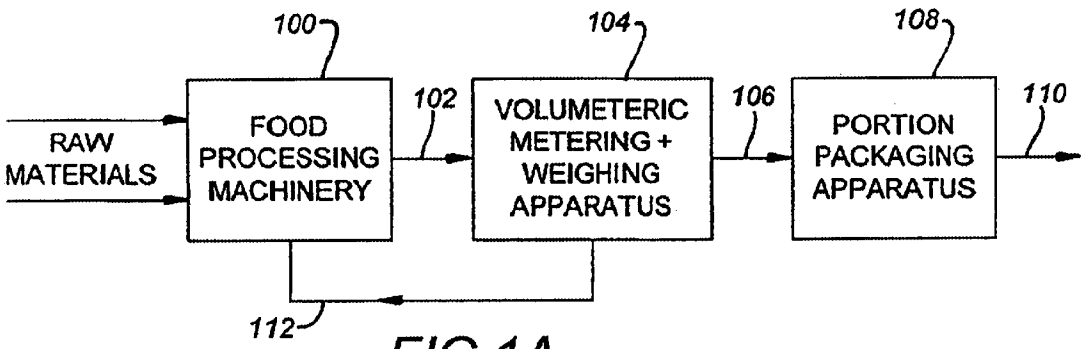
FIG. 1A is a schematic illustration of a food preparation system in which raw materials are processed into continuous particulate matter, then portioned into individual portions of particulate matter, and then packaged.

FIG. 1A illustrates the overall food processing system. On the left hand side, raw materials such as water, flour, grains, fruit, preservatives, humectants, sugar, vitamins, and the like, are input into the food processing machinery 100. Food processing machinery 100 forms the raw materials into a continuous stream of particulate matter 102. This particulate matter may be beads, pellets, flakes, or other small, discrete portions of food. The continuous stream of particulate food matter is combined, metered by volume and weighed in a volumetric metering and weighing apparatus 104. The apparatus divides the continuous stream of particulate food matter 106 into individual portions of food that are to be packaged. The portioned particulate food matter 106 is then directed to the portion packaging apparatus 108. In this apparatus, each of the portions that were provided to the apparatus 104 are individually wrapped, such as in waxed paper, plastic film, cardboard boxes or the like, and exit the system for distribution as shown by arrow 110. In the volumetric metering apparatus 104 a signal 112 indicative of the bulk density of the continuous particulate matter is generated and transmitted to the food machinery 100.

Figure 1B:
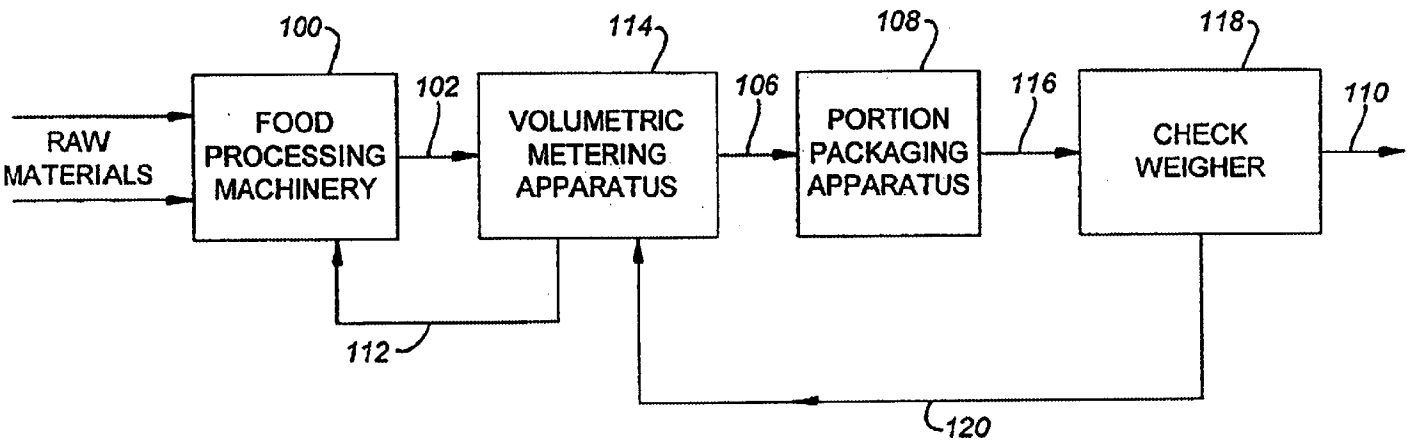
FIG. 1B shows an alternative embodiment of a food preparation system with a checkweigher.

FIG. 1B shows an alternative embodiment of the system illustrated in FIG. 1A. Raw materials are input into food processing machinery 100. Food processing machinery 100 processes raw materials into a continuous stream of particulate matter 102. The continuous stream of particulate matter 102 is combined and metered by volume in the volumetric metering apparatus 114. Alternatively, but not diagrammatically shown, apparatus 104 of FIG. 1A may be substituted for apparatus 114 of FIG. 1B. The continuous stream of particulate food matter 102 is divided into individual portions of food that are to be packaged. The portioned particulate matter 106 is then directed to the portion packaging apparatus 108. The portion packaging apparatus 108 individually wrap each of the individual portions of particulate matter. The individually wrapped products 116 continue through a checkweigher 118 and exit the process for distribution as shown by arrow 110. A weight measurement signal 120 is generated by checkweigher 118 and sent to the volumetric metering apparatus 114. Signal 112 is generated by apparatus 114, and is indicative of the bulk density of the continuous particulate matter, and signal 112 is transmitted to the food processing apparatus 100. Bulk density is calculated from known volume of particulate food matter and a weight measurement obtained from a weight sensing device, such as but not limited to a weigh bucket, centripetal force meter or checkweigher. This signal indicative of the bulk density 112 is used to control food processing machinery 100 such that the machinery generates a revised stream of continuous particulate matter that is closer to the target bulk density.

Figure 2:
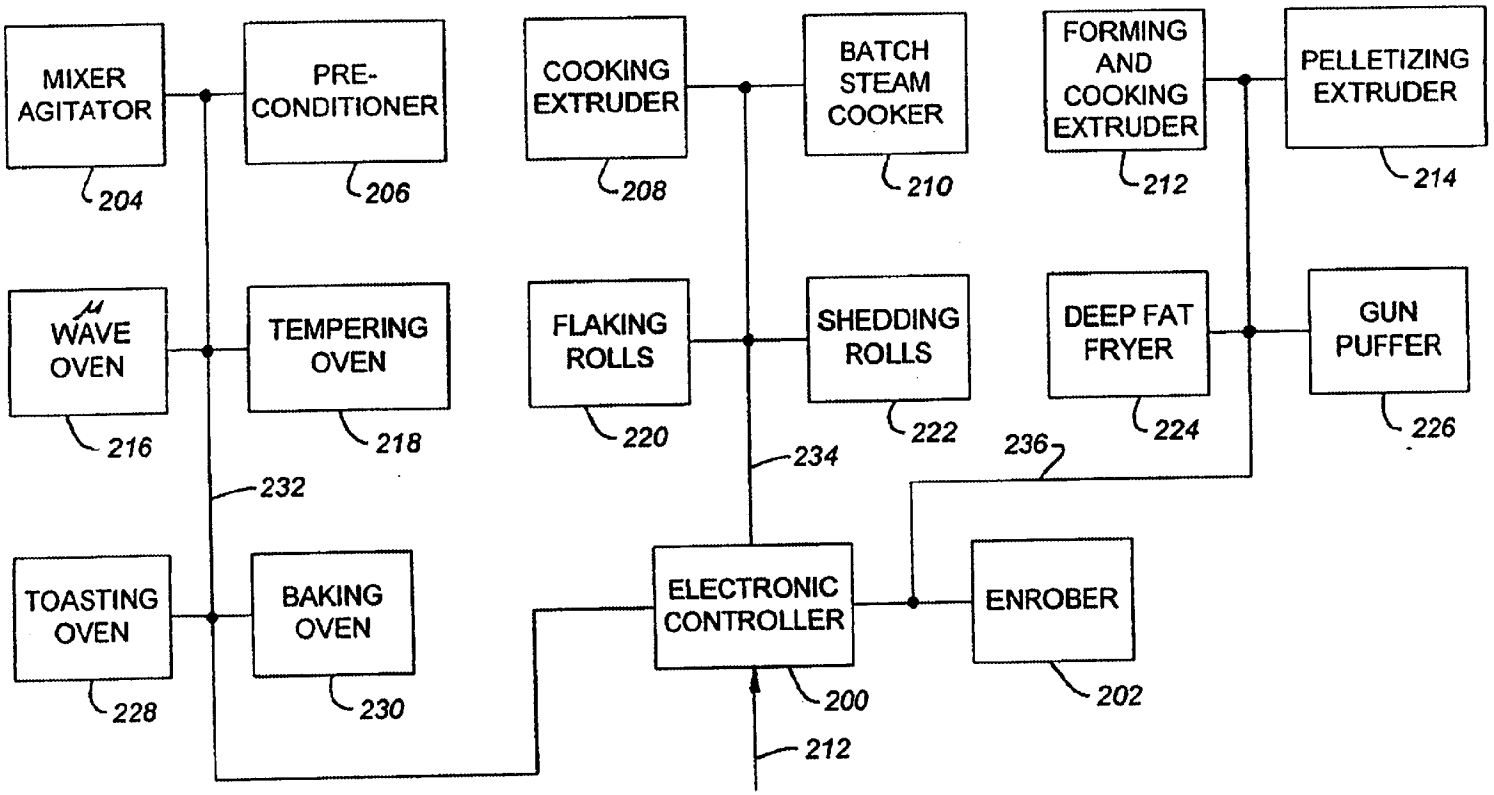
FIG. 2 is a schematic diagram of the food processing shown in FIGS. 1A and 1B and of the electronic controller that communicates with the food processing machinery and regulates operational parameters of the food processing machinery based upon a bulk density signal received from the volumetric metering apparatus.

FIG. 2 illustrates one embodiment of the food processing machinery of FIG. 1. In this embodiment, an electronic controller 200 receives the bulk density signal 112 and responsibly controls, based upon the magnitude of that signal, a variety of food processing devices. The electronic controller 200 is electrically coupled to these devices and receives sensor signals therefrom and calculates and applies actuator signals thereto. The devices include a enrober 202, mixer/agitator 204, a pre-conditioner 206, a cooking extruder 208, a batch steam cooker 210, a forming and cooking extruder 212, a pelletizing extruder 214, a microwave oven 216, a tempering oven 218, flaking rolls 220, shredding rolls 222, deep-fat fryer 224, gun-puffer 226, toasting oven 228, and baking oven 230. Each of the devices 202–230 transmits sensor signals to controller 200 over communications lines 232, 234, and 236. Electronic controller 200 transmits control signals to drive the various actuators on these devices over communications lines 232, 234 and 236 as well. Each of the devices 202–230 may include an integral electronic controller to receive sensor signals and provide actuator signals to the mechanical and electrical components of that device. In this embodiment, communications lines 232, 234 and 236 are coupled to the electronic controllers in each of the devices 202–230 and communicate with the on-board electronic controller for that device. Electronic controller 200 may be a PLC or, preferably, an industrial PC.

Mixer/agitator 204 may be a paddle blender, a double ribbon blender, a paddle/ribbon blender, a plow blender/turbulent mixer, a fluidizing Forberg-type mixer, an air mixer, a V-blender, a cone mixer, a single blade mixer, or a speed flow continuous mixer. The mixer may be oriented vertically or horizontally. It preferably includes a variable speed motor coupled to the paddles or agitators, a control valve for regulating a flow of steam or hot water to the mixer 204 to regulate the flow of steam or water to the mixer in models so equipped. It also includes a temperature sensor that provides a temperature sense signal indicative of the raw material being mixed or agitated therein. The variable speed motor and control valves are controlled by signals provided either by the internal PLC or by electronic controller 200 over communication line 232. The temperature sensor provides temperature signal to electronic controller 200 indicative of the temperature of the mix also over communication line 232. The motor and control valve in mixer 204 may be driven directly by an on-board PLC or may receive their control signals from electronic controller 200.

Preferred mixers include the automated mixers provided by AMF Bakery Systems, Air Process Systems & Conveyors Company, Inc., and Dunbar Systems, Inc. Most preferred is the TBM Series Tilt Bowl Mixer manufactured by AMF that includes a PLC configured to control mixing speed, mixing and refrigeration time, and dough temperature.

Cooking extruder 208 and forming and cooking extruder 212 are preferably a twin screw extruder having a variable speed drive motor coupled to a splitter/reduction gear box to drive both screws. The motor is preferably a DC drive motor. The extruder preferably includes a pressure and temperature transducer fitted to the die block to monitor the temperature and pressure of the material being extruded. In addition, these extruders preferably include at least one electrical heating element (although steam may be used) that is connected to a variable power control to regulate the degree of heating. When steam is used, the extruder preferably includes an electronic control valve configured to throttle the steam provided to the extruder thereby permitting the temperature of the extruder and hence the material being extruded to be varied. In addition, a water-cooling jacket is preferably provided around the shell of the extruder to cool the extruder and hence the material when temperatures become too high. These extruders preferably include a dedicated controller, preferably a PLC that directly controls the motor drive and monitors the pressure transducer temperature transducer and controls the valve regulating steam flow rate and the power circuitry controlling the flow of electricity to the electrical heating elements. A preferred extruder 208 or 212 is the MPF Series Extruders manufactured by APV Baker, Inc. Another preferred extruder, in accordance with the foregoing description, includes the Wenger Magnum Series Twin Screw Extruder as configured with the Wenger Automatic Process Management System software operating in conjunction with the Wenger PLC.

The pelletizing extruder 214 is preferably a single screw extruder driven by a variable speed motor, preferably a DC or AC variable speed motor coupled to a gear reducer. The barrel of the extruder includes a water jacket disposed to conduct heat from the extruded material into circulating cold water. The extruder screw is preferable cored for water-cooling as well. An electronic control valve is coupled to the water jacket to provide electronic control of cooling flow rate through the water jacket. The temperature sensor is disposed on the barrel in at least one region, to sense the temperature of the barrel and provide feedback for the appropriate cooling. A die plate is fixed to the exit end of the extruder barrel and includes a plurality of passages through which the extruded material is forced. The extruder also includes an adjustable die face cutter having a multi-bladed knife disposed to rotate across the outer face of the die and cut off individual pellets as they pass through the passages in the die. This multi-bladed knife is coupled to a variable speed motor drive to control the rate at which individual pellets are cut off and thereby to control the size of the pellets that are produced. A preferred extruder in accordance with this description is the APV Baker Incorporated BPF-200 Series Extruder. The pelletizing extruder 214 preferably includes a PLC coupled to and configured to drive the variable speed motor that rotates the screw with respect to the barrel and the variable speed motor drive that rotates the multi-bladed knife with respect to the outwardly facing die face.

Microwave oven 216, tempering oven 218, toasting oven 228, and baking oven 230 may be any of a variety of food processing ovens, such as infra-red ovens, convection ovens, fluidized bed ovens, microwave ovens, or ovens having a combination of these heating technologies inside. A preferred oven for use in toasting food products such as cereal flakes is the APV Baker Thermo Glide Toaster. This system includes an electronically controlled fan to vary the flow rate of hot air circulating around the particulate food as well as several temperature sensors responsive to the air temperature of the air within the oven and at least one variable speed motor for controlling the speed of the internal conveyor that conveys the particulate food matter through the oven. Ovens based on microwave technology include both a microwave generator and a microwave applicator. The microwave generator portion of the microwave oven preferably includes a PLC configured to continuously vary the power output over the entire range of 0% to 100%. A preferred microwave generator for use with the microwave oven is the Amana QMP-1759 Microwave Generator. A preferred microwave applicator is shown in U.S. Pat. No. 5,457,303, which is incorporated herein for all that it teaches. Alternative microwave applicators include any of the QMP-2103 Series Amana microwave continuous cooking systems.

Flaking rolls 220 are preferably of a dual-roll design having two pressure rollers with parallel axes that are closely aligned to each other to provide a small gap therebetween in which the pellets are crushed and turned into flakes. An example of such a flaking roll system can be found in U.S. Pat. No. 5,018,960. The system disclosed in the '960 patent, which is incorporated herein for all that it teaches, is preferably modified to include a stepping or servo motor coupled to threadably adjustable devices 136 (shown in the '960 patent) to rotate those devices and thereby change the nip clearance between the flaking rolls under electronic control such as by a belt or gear engagement. In addition, in a preferred embodiment these servo or stepping motors are preferably controlled by an on-board PLC in the block indicated by flaking rolls 220 in FIG. 2, thereby permitting flaking rolls 220 to communicate with electronic controller 200 over communications line 234. In this manner, electronic controller 200 can control the nip clearance between the flaking rolls, either directly by being coupled to the motor driving the threadably adjustable devices 136 (as shown in the '960 patent) or by transmitting signals to the PLC that is on-board flaking rolls 220 and directing that PLC to control the nip clearance between the flaking rolls. In addition, electric motor 130 in the flaking roll apparatus (as shown in the '960 patent) preferably a variable speed DC or AC motor that is similarly connected via communication lines 234 to electronic controller 200 or to the on-board PLC which in turn controls motor 130 (as shown in the '960 patent) and is responsive to motor speed commands transmitted by electronic controller 200 over communication lines 234. In this manner, electronic controller 200, either directly (by direct coupling to the drive motor 130 of the '960 patent) or indirectly (by coupling to drive motor 130 (of the '960 patent) through the on-board PLC of flaking rolls 220) is capable of varying the speed of the flaking rolls as well as varying their spacing. In an alternative embodiment of flaking rolls 220, threadably adjustable devices 136 (as shown in the '960 patent) are replaced with a hydraulic cylinder that can extend to increase the nip clearance or retract to reduce the nip clearance between the flaking rolls 76, 78 (of the '960 patent). In a system such as this, the hydraulic cylinder is fluidly coupled to a hydraulic power unit (also included with flaking rolls 220) and the flow of fluid between the hydraulic power unit and the hydraulic cylinders is regulated by a bi-directional electro-hydraulic control valve disposed in hydraulic conduits coupling the hydraulic power unit to the flaking roll assembly such that by the application of electrical signals to the electro-hydraulic control valve it can increase the nip clearance between the rolls or decrease the nip clearance between the rolls, and can provide a predetermined load by regulating the hydraulic pressure in the cylinders which are directly proportional to the closing force holding the two rolls together. This electro-hydraulic control valve is preferably coupled indirectly to electronic controller 200 through the on-board PLC, which is coupled to and in communication with communication lines 234 and thereby with electronic controller 200.

Shredding rolls 222 are formed in the conventional fashion as a plurality of rolls arranged in several roll stations, each station having two rolls, at least one of which having a plurality of circumferential grooves defined on an outer surface thereof, such that when the extruded food product is provided to the station or stations, comprising the shredding rolls or shredding mill, each station will subdivide or shred the material into a plurality of longitudinal threads of food product. Shredding rolls 222 preferably include a plurality of variable speed drive motors that drive the shredding rolls in each roll station or stand, and are coupled to the actual rolls to permit their speed to vary under electronic control. Similarly, each of the actual rolls is provided with internal passages through which cooling fluid (typically water) is conducted to cool the rolls during operation. An electrical proportional control valve is also provided as part of the shredding rolls 222 fluidly connected between the source of cooling water and the rolls themselves to regulate the flow of this cooling fluid through the rolls, thereby controlling the temperature of the rolls and the amount of cooling. In addition, shredding rolls 222 include at least one temperature sensor disposed to detect the temperature of the rolls and/or cooling water, and thereby permit the regulation of the temperature of the rolls by opening and closing the cooling fluid valve in response to the temperature. The motors, valve and sensors of the shredding rolls 222 are coupled over communication lines 234 to electronic controller 200, thereby permitting electronic controller 200 to vary the speed of the rolls, vary the amount of cooling fluid passing through the rolls, and control the temperature of the rolls.

In an alternative embodiment, shredding rolls 222 include a PLC coupled to the motors, valve and temperature sensors. In this embodiment, the PLC is coupled to the electronic controller 200 and is configured to receive motor speed commands and cooling commands from electronic controller 200. Examples of shredding rolls in accordance with the present invention are the shredding mills or rolls manufactured by Wolverine Corporation, such as the Wolverine 16 Station Shredding Line.

The food processing devices illustrated in FIG. 2 produce a continuous stream of particulate food matter 102, according to any of a variety of product recipes. Several of these recipes are disclosed in U.S. patents, for example U.S. Pat. No. 5,510,130; U.S. Pat. No. 5,709,902; U.S. Pat. No. 5,182,127; U.S. Pat. No. 4,844,937; and U.S. Pat. No. 5,919,503, all of which are incorporated herein by reference for all that they teach.

Depending on the particular food preparation process required, and as shown in the aforementioned patents and text, each of the devices 202–230 can be provided with raw material and can sequentially process the raw materials to produce the continuous particulate matter. The particular order in which the devices are used to process these raw materials are shown in the aforementioned patents.

Any of the actuators that have been described above and form a part of devices 202–230 will change the bulk density of the finished food matter, the continuous particulate food matter, and thus may be moved or otherwise varied, either in speed, position, length of time of operation, or temperature, to achieve a preferred bulk density to the particulate food matter produced by the food processing machinery. For example, changing the quantity of raw materials provided to the mixer/agitator will change the bulk density of the continuous particulate food matter. Changing the temperature at which any of the devices works by varying the heating or cooling applied to the devices will also vary the bulk density. Changing the speed at which any of the devices 202–230 operates will also alter the bulk density of the continuous particulate food matter.

Not all of the devices 202–230 are required for every possible process, however. For example, when producing breakfast cereal flakes, flaking rolls 220 would be used and shredding rolls 222 would not be used. Conversely, when manufacturing a shredded breakfast cereal, shredding rolls 222 would be used and flaking rolls 220 would not. Similarly, when making toasted flaked products, one of the ovens 216, 218, 228 or 230 would be used to toast the product and deep fat fryer 224 would not be used. When preparing puffed cereal products, gun puffer 226 would be used to puff the cereal and deep fat fryer 224 would not be used.

Figure 3:
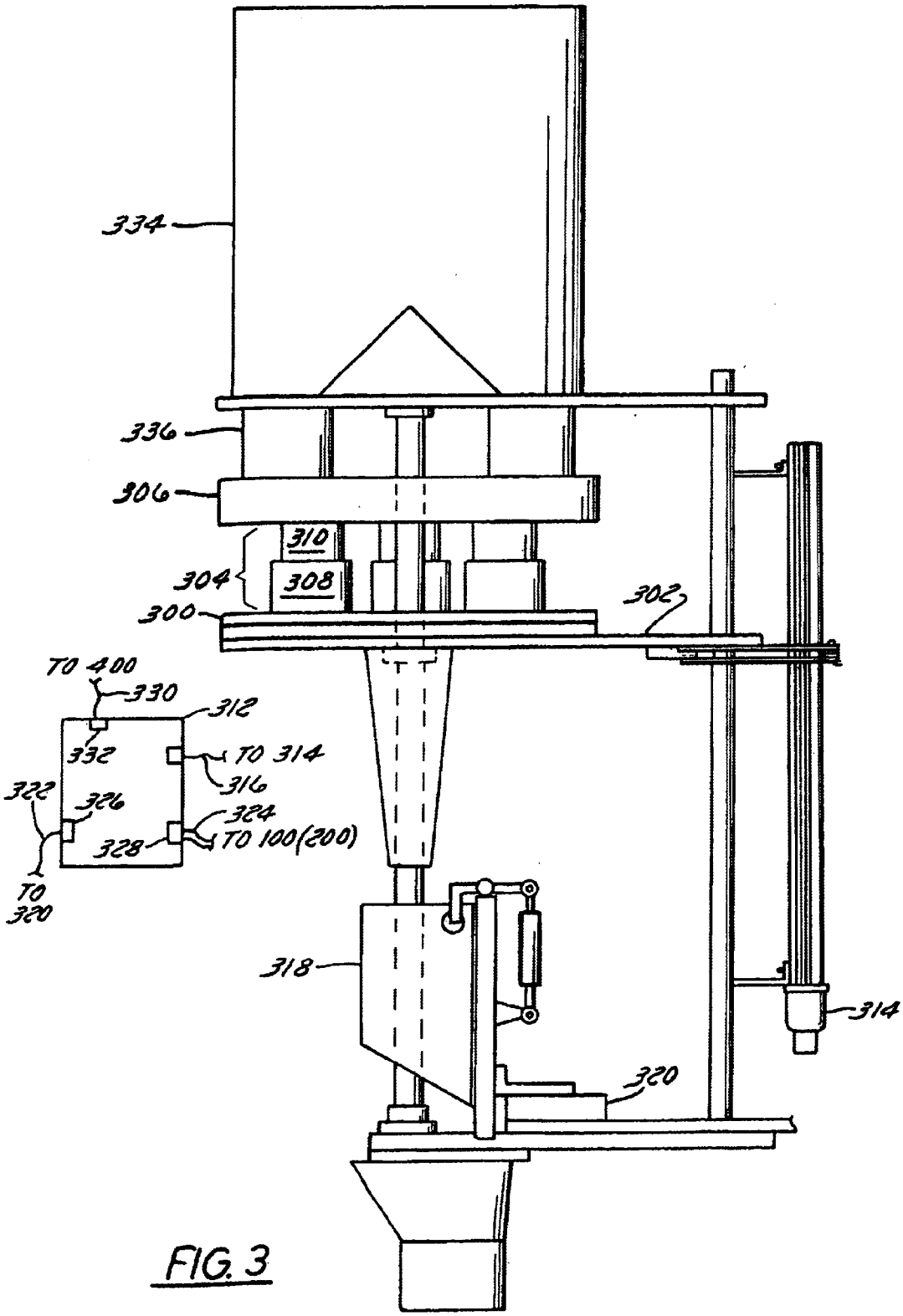
FIG. 3 illustrates the volumetric metering apparatus including a cup filler having a distance measuring device mounted on it for determining the relative position of the bottom plate with respect to the top plate to determine the volume of the cups, as well as an electronic controller that receives a signal from this distance measuring device.

FIG. 3 illustrates a volumetric metering apparatus illustrated in FIG. 1, a volumetric filler shown here as a cup filler. The preferred embodiment of the cup filler is shown in the attached non-provisional patent application Ser. No. 10/062,966, entitled "APPARATUS FOR METERING AND PACKAGING BULK PARTICULATE OR FLAKED MATERIAL", Jan. 31, 2002, which is incorporated herein for all that it teaches. In particular, the cup filler includes two buckets disposed underneath discharge chutes to weigh the measured volume of particulate food matter, in the present case the particulate food matter is placed in each bucket. As the cup plate 300 rotates, resting on the bottom plate 302, it sequentially and alternately empties each filled cup 304 into a bucket. Each of the cups 304 provides the volumetric metering and portioning capacity of the system. Each cup 304 has a predetermined volume that is varied by raising or lowering the bottom plate 302 with respect to the top plate 306. By altering the overlap of the two cylinders 308 and 310, which comprise each one of the cups 304, the volume of the each cup 304 is changed thereby changing the volume of dispensed particulate food matter.

Figure 4:
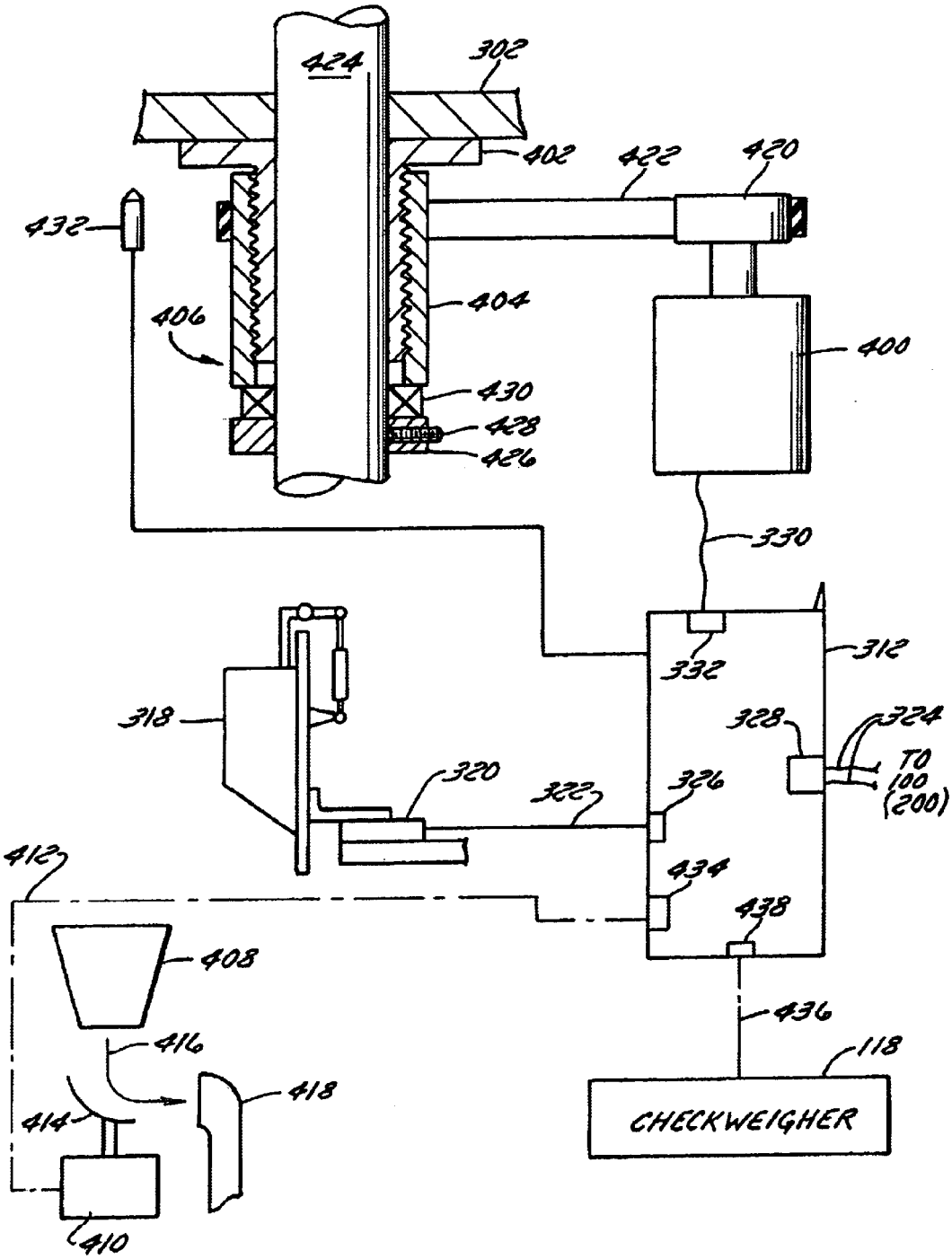
FIG. 4 is a fragmentary cross-sectional view of an actuator used to raise a bottom plate of a cup filler with respect to a top plate, as well as the sensors and instrumentation for driving the actuator, and for weighing individual portions of food through use of either a weigh bucket or alternative embodiments of a checkweigher or centripetal force meter.

Now referring to FIG. 4, an actuator 406, as described in above referenced application Ser. No. 10/062,966, is configured to raise and lower the bottom plate 302 thereby varying the volume of the cups. As shown, actuator 406 is in the form of a first externally threaded cylinder 402 that is threadedly engaged to an internally threaded cylinder 404. Internally threaded cylinder 404 is supported on locking ring 426, which is pinned via pin 428 to output shaft 424. A thrust bearing 430 is disposed between ring 426 and cylinder 404 to support the weight of cylinder 404 and to permit it to remain stationary while output shaft 424 rotates. Since cylinder 402 is threadedly engaged with cylinder 404, it is also supported by cylinder 404 on bearing 430 and its weight is similarly transferred to ring 426 and through pin 428 to shaft 424. A motor 400 is coupled to a drive pulley 420 to rotate drive pulley 420. Pulley 420 is coupled to cylinder 404 by belt 422, which extends completely around both drive pulley 420 and cylinder 404. Thus, as pulley 420 is rotated by motor 400, outer cylinder 404 rotates as well. When cylinder 404 rotates, it either raises or lowers cylinder 402 due to the threading action of their mutually engaged threads. Thus, bottom plate 302, which rests on cylinder 402, can be raised or lowered by the motor 400 whenever motor 400 operates. Referring to FIG. 3, when bottom plate 302 is raised and lowered, it raises and lowers the cup plate 300. Cup plate 300 and top plate 306 rotate with respect to bottom plate 302 and move both first cylinder 308 and second cylinder 310 of each of the cups. When cup plate 300 is raised or lowered, the first cylinder 308 moves relative to the second cylinder 310, which is stationary, of each cup 304. As a result the cylinders move together and overlap more or pull apart and overlap less. When they move together, they serve to reduce the volume of each of cups 304. When they pull apart and overlap less, they serve to increase the volume of each of cups 304. In this manner, motor 400 functions to change the volume of the cups either by increasing or decreasing the volume.

Figure 12:
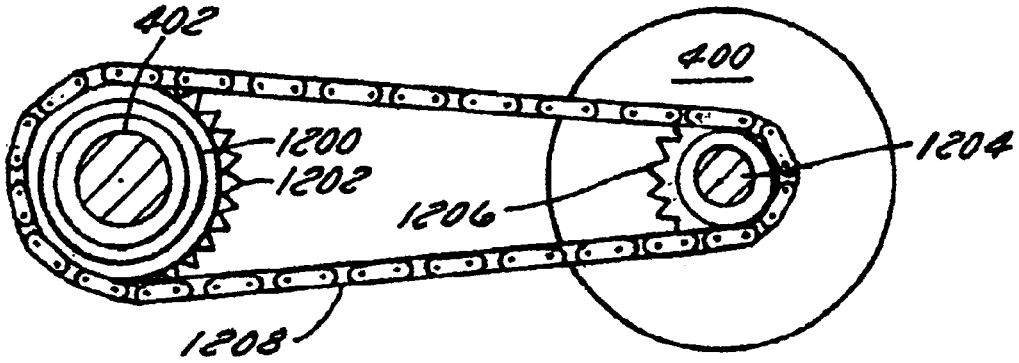
FIG. 12 is a top view of the actuator 316 of FIG. 3 taken at section line 12—12 in FIG. 3 and showing a chain and sprocket arrangement.

While the embodiment shown in FIG. 4 includes a belt that engages cylinder 404 to motor 400, in an alternative embodiment a chain is preferred as shown in FIG. 12. Referring now to FIG. 12, cylinder 404 can be replaced with an alternative cylinder 1200 having a plurality of gear teeth 1202 extending outwardly from its outer surface and collectibly defining a sprocket. In a similar fashion, the pulley 420 of FIG. 4 can be replaced with a pulley 1204 having a plurality of outwardly extending teeth 1206 that collectably define a sprocket. About these two sprockets, a chain 1208 can be used instead of timing belt 422 shown in FIG. 4.

Referring now to FIG. 3, controller 312 is shown as it is connected to an additional device in the system, a relative position-indicating device 314. Device 314 is preferably a position sensor utilizing magneto restriction technology, such as the Temposonics RH series, fixed to bottom plate 302 and providing a signal indicative of the distance between bottom plate 302 and top plate 306. However, other position sensing devices may be used, such as an ultrasonic range finding device. The device shown in FIG. 4, with the exception of device 314 and PLC 312, is the cup filler illustrated in FIGS. 1–4G of non-provisional patent application Ser. No. 10/062,966 entitled "APPARATUS FOR METERING AND PACKAGING BULK PARTICULATE OR FLAKE MATERIAL".

Device 314 determines the relative distance between plates 302 and 306 based upon the elapsed time between the launching of the electronic interrogation pulse and arrival of the strain pulse. It then provides a signal indicative of the distance between the two plates on signal line 316, which is coupled to controller 312 and device 314. In this manner, controller 312 is made aware of the relative spacing of plates 302 and 306, and any changes in the spacing of the two cylinders 308 and 310 that comprise each of cups 304. Position sensors appropriate for use as device 314 are manufactured by Temposonics, whereas ultrasonic range finders appropriate for substitution of device 314 are manufactured by Hyde Park.

Figure 6:
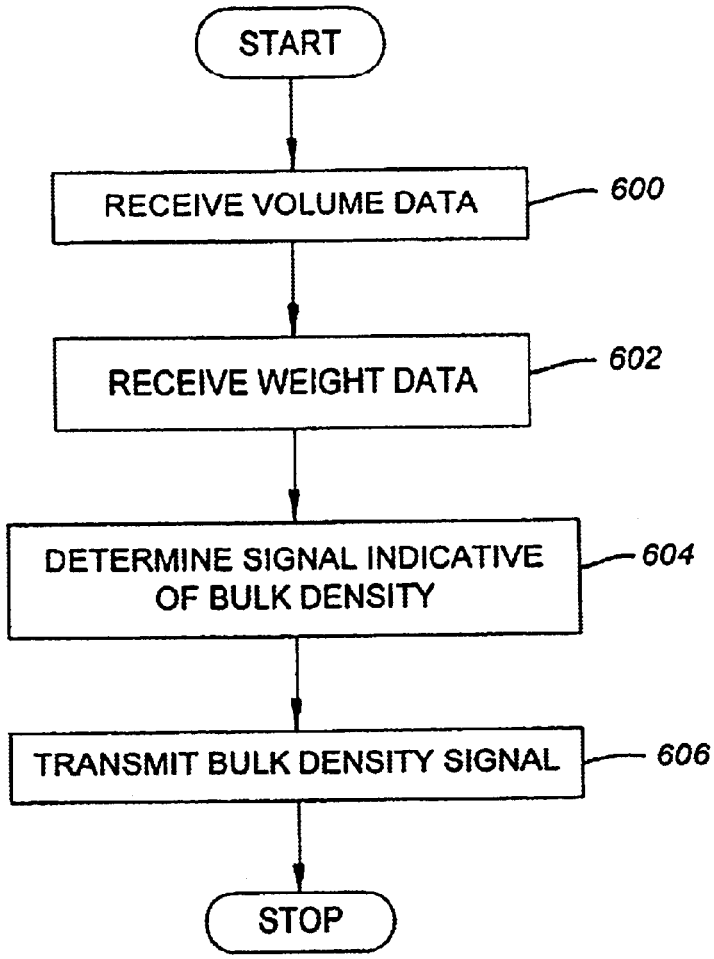
FIG. 6 is a flow chart of the steps performed by the electronic controller of the volumetric metering apparatus to determine the bulk density of the particulate matter.

Controller 312 is configured by an internal program to provide several signals on signal lines 324. One or more of these signals are indicative of the bulk density of the product. As described above, the bulk density of the product is defined as the ratio of the weight of a predetermined quantity of the particulate matter, and the volume of that predetermined quantity. FIG. 6 is a flow chart of the digital program executed by controller 312 in which it determines and transmits the signal or signals indicative of bulk density, as described more fully below.

At the bottom of FIG. 4 is a schematic representation of a weigh bucket 318. Each bucket is mounted on a load cell 320, which includes one or more force measuring devices. These force-measuring devices communicate an electrical signal indicative of the weight of the bucket and its contents over electrical signal line 322. In this manner, an electrical signal is produced, indicative of the weight of the bucket and its contents, for future processing. In a similar fashion, motor 400 is driven by an electrical signal provided on signal line 330. Both lines 322 and 330 are electrically connected to electronic controller 312, here shown as a programmable logic controller or PLC. Alternatively electronic controller 312 may be an industrial PC. Motor driver circuits 332 are provided to generate an electrical signal of sufficient magnitude to drive motor 400. Signal conditioning circuit 326 is provided to condition electrical signals provided by load cell 320 to controller 312 over signal lines 322. Controller 312 is configured to generate a plurality of signals that are provided to communication circuit 328, which then applies them to signal lines 324. The signals on signal lines 324 comprise the signal or signals indicative of bulk density that is/are provided to the food processing machinery in block 100, and, more particularly, to electronic controller 200 in FIG. 2.

Figure 5:
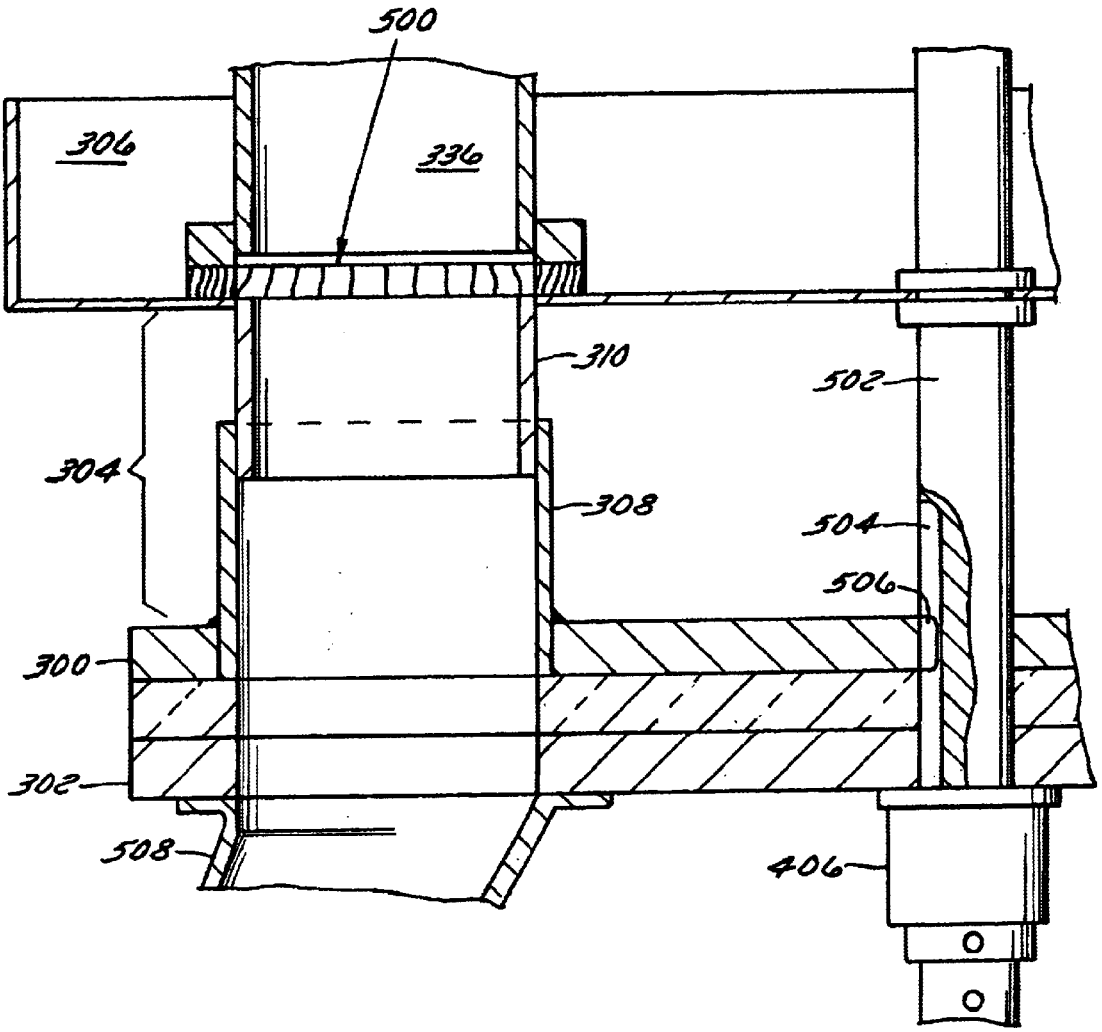
FIG. 5 is a close-up view of a cup and actuator of the cup filler of FIG. 4.

FIG. 5 is a fractional cross sectional view of outlets 336, top plate 306, cups 304, passages 500, cup plate 300, and bottom plate 302. Outlets 336 extend downward from hopper 334 into top plate 306, which is formed as a circular pan or tray.

The cups 304 are in the form of two cylinders. A first cylinder 310 is fixed to and extends below top plate 306. Passage 500 defines the opening of first cylinder 310. Cylinder 310 is preferably circular in cross section, and is fitted into second cylinder 308.

The volume of cups 304 can be varied by raising and lowering bottom plate 302 with respect to top plate 306. This raising and lowering is provided by actuator 406, which is pinned to shaft 502. Actuator 406 expands or retracts in length in response to an electrical signal generated by the electronic controller for this system. It is pinned to shaft 502 and supports bottom plate 302, and cup plate 300, including second cylinders 308. When it expands in length, its top portion 504 raises with respect to shaft 502. Since bottom plate 302 and cup plate 300 rest on actuator 406, they are also raised. Cup plate 300 may be keyed to shaft 502 by key 506. Key 506 slides upward in key slot 504 thereby keeping cup plate 300 rotationally coupled to shaft 502 in a plurality of vertical positions. When cup plate 300 is raised, cylinder 308 moves upwards around the outer surface of cylinder 310. Since the two cylinders define the volume of each cup 304, this upward motion causes a reduction in cup volume, and hence a reduction in the volume of bulk material metered into each cup. A similar increase in cup volume can be created by lowering the upper portion of actuator 406 thereby causing cylinder 308 to slide downward realtive to cylinder 310.

In FIG. 5, outlet 336, top plate 306, passages 500, cylinders 308 and 310, cup plate 300 and bottom plate 302 are shown as forming one long continuous path through the system. This is not the orientation that they have in reality. If it were, cups 304 would provide no metering capability. As soon as outlet 336 was positioned over passage 500, an unlimited quantity of bulk material would fall through the continuous passage formed by these elements until virtually the entire system was filled with bulk material.

FIG. 5 illustrates these elements as being vertically aligned simply for convenience of illustration. In fact, they are rotationally staggered in a specific fashion that permits cups 304 to be filled in one position and emptied in a second position. For this reason, when outlet 304 is oriented over the top of cup 304 and bottom plate 302 are not in the position shown in FIG. 5. In fact, they are rotated to a different position in which the passage through bottom plate 302 is not below cup 304. In this position bottom plate 302 provides a solid base to cup 304 thus permitting the cup to be filled. In a similar fashion, when the opening in bottom plate 302 is in the position shown in FIG. 5 to permit the bulk material previously placed in cup 304 to fall into drop tube 508, outlet 336 is not positioned above cup 304.

In step 600 of FIG. 6, controller 312 receives data indicative of the volume of the cups 304. In the preferred embodiment, device 314 generates a signal indicative of the relative spacing of top plate 306 and bottom plate 302. This distance is related to volume by a linear relationship (given the right-cylindrical shape of cups 304) by the equation $Y=MX+B$, where X is the distance between the two plates, Y is the volume, M is a constant and B is a constant. Thus, there is a linear relationship between X and Y based upon the known inside diameters of the cups and the relative shapes of the cylinders comprising the cups 304.

In an alternative embodiment for determining volume, controller 312, which drives motor 400, is programmed to maintain a counter in its electronic memory that is equivalent to the rotational position of motor 400. Since the rotational position of motor 400 corresponds directly to the threaded engagement of the two cylinders, 402 and 404, and since the threaded engagement of these cylinders also indicates the height of bottom plate 302 with respect to top plate 306, the rotational position of motor 400 also indicates the volume of the cups by the relationship Y=MX+B, where X is the rotational position of motor 400, Y is the volume of cups 304 and M is a constant and B is a constant. Thus, even when there is no separate device 314, the volume of cups 304 can be determined by tracking the rotational position of motor 400 which drives bottom plate 302 up and down in a counter that is incremented or decremented when in a preferred embodiment, an initialization program is provided in controller 312 in which motor 400 is driven to a predetermined position and zeroed out. By "predetermined positions", it is meant that the bottom plate would be moved until the cups have a known and predetermined volume and the motor counter in controller 312 would be set to a known value (such as zero) associated with this known volume. This "zeroing out" would then permit the volume to be determined based on relative motions of motor 400. This process of initializing a counter based on the rotation of motor 400 could be automated by providing an electrical limit switch 432 that would be engaged by bottom plate 302 when it reached the predetermined position for zeroing out. Controller 312, connected to the switch, will drive motor 400 until it sensed that the switch was engaged, thereby indicating that the cups 304 were in their position of predetermined volume. At which time, controller 312 will set the counter indicative of the motor's 400 rotational position to the predetermined value.

While the preferred embodiment permits the bottom plate 302 to be driven up or down with respect to the top plate 306 and thereby permits the volume of each of the cups 304 to be varied dynamically, this is not an essential requirement in determining the bulk density of the particulate food matter or of providing a signal or signals indicative of bulk density. Since bulk density is a ratio of volume to weight, if the cups have a fixed volume, the bulk density will vary only with the weight.

In step 602, controller 312 receives data indicative of the weight of a portion of particulate food matter deposited in a weigh bucket 318. In the preferred embodiment, load cell 320 includes circuitry 326 to generate a digital value indicative of weight. This data is transmitted over signal lines 322 to circuitry 326 in controller 312. In this embodiment, device 320 is preferably a Tedea Model 910 Load Cell combined with a GSE 460 indicator. The Tedea Model 910 Load Cell provides an analog signal, and the GSE 460 indicator converts that analog signal to digital format. It is this data that is preferably provided over signal line 322 to controller 312. Alternatively, the Tedea Model 910 load cell could be used as device 320 and the analog signal provided by the load cell on line 322 is sent directly to PLC 312. In this embodiment, circuitry 326 would comprise an analog-to-digital converter. If controller 312 was an Allen-Bradley PLC, circuit 326 could be an analog-to-digital converter card manufactured by Hardy. Of course, any arrangement of strain gauges, load cells, or other deflection-measuring device that generates a signal indicative of the weight of the contents of the bucket could be used as device 320.

In the preceding examples, the weight that was determined was the weight of a predetermined quantity of particulate food matter metered by a cup 304 into a fixed and stationary weigh bucket 318. In an alternative embodiment, however, the weight of the predetermined quantity of material metered by each cup 304 as it directs particulate matter into drop tube 408 could be measured by a centripetal force meter instead of weigh bucket 318 and device 320. Referring back to FIG. 4, in this alternative embodiment, as each cup 304 deposits the measured volume of particulate food matter into drop tube 408, it would be directed into or against centripetal force meter 410. Centripetal force meter 410 can be used in place of weigh bucket 318 and device 320, and would be connected to controller 312 by signal line 412 and circuitry 434. In addition checkweigher 118 is shown in FIG. 4 as an alternative embodiment for determining the weight of the particulate food matter. The checkweigher 118 is downstream of the food packaging and would be connected to controller 312 by signal line 436 and circuitry 438.

The checkweigher maybe used to replace or work in conjunction with either the weigh bucket or centripetal force meter weight sensor devices. In the alternative embodiment shown in FIG. 1B, a checkweigher 118 located downstream of the packaging replaces the weigh bucket. The checkweigher measures the weight of the finished product. This value is compared to a reference value. Previously entered reference and deviation values are product specific. Volume information, combined with information relating to weight, from the checkweigher, is received by the PC/PLC. Information received by the PC/PLC is used to calculate bulk density, which in turn is used to thereby change upstream activities of the food processing machinery in order to obtain optimal product weight and bulk density.

In the alternative centripetal force meter embodiment, material is released from cups 304 and enters drop tubes or spouts 408, it is directed downward against plate 414, which is mechanically coupled to meter 410. Plate 414 causes the particulate food matter to deflect in its direction of travel as shown by arrow 416, which describes the path of the matter from drop tube 408 into feed tube 418. As the matter is steered in a curved path, it deflects plate 414, which in turn deflects measuring devices inside meter 410. This deflection is amplified and turned into an analog or digital signal indicative of the force applied to plate 414 and is provided over signal line 412 to controller 312. A preferred centripetal flow, meter for use in this system is the CFM Series centripetal force meter manufactured by CentriFlow. Of the meters in that series, the CentriFlow CFM-6 is especially preferred. The use of weight bucket 318 and centripetal flow meters 410 are two types of alternatives in place of a checkweigher 118. These two alternatives, if so desired, may also be used with the addition of a checkweigher 118.

The next step in the process of generating and transmitting the bulk density signal to controller 200 (i.e., food process 100) is that of determining the signal indicative of bulk density. As noted above, if cups having a fixed volume are employed in the cup filler (i.e., bottom plate 302 is not adjusted with respect to top plate 306) then the bulk density signal can be derived strictly from the weight data. The step of determining the signal indicative of bulk density is simply that of providing the signal indicative of the weight that is received from multiple types of devices 410, 320 or 118 as mentioned above. Each of these devices provides a signal indicative of the weight of a discreet volume or portion of particulate food product. Since the volume is fixed (in this example), the bulk density varies in direct relationship to the weight. Since bulk density is expressed as weight per unit volume, and since volume is fixed, the relationship is as follows:

$$Y=MX$$

where Y is the bulk density, X is the weight (derived from the signal provided by device 410, 320 or 118), and M is a constant of proportionality. An appropriate correction factor is provided in controller 200 to properly format the data for use in the food process control algorithms executed by controller 200. It should be clear that the weight in itself, for a cup filler having a fixed volume cup 304, is a signal indicative of bulk density 112.

In cup fillers such as the preferred embodiment shown herein where the volume can change as well as the weight, the signal indicative of bulk density 112 is a product of both the volume signal provided by sensor 314 and the weight signal provided by devices 410, 320 or 118. Again, since bulk density is the ratio of weight to unit volume, controller 312 can directly calculate a value or signal indicative of bulk density by dividing the signal received from device 410, 320 or 118 by the signal received from sensor 314. Expressing this in general form, $$Y=M(W/V)+B$$

where Y is a value indicative of bulk density, M is a constant of proportionality, W is a value indicative of the weight signal received from devices 410, 320 or 118, V is a value indicative of the volume signal received from device 314 and B is a second constant. Controller 312 is preferably configured to calculate Y and thereby provide a single value indicative of the bulk density of a measured portion of the particulate food matter. It should be clear that various additional scaling factors and offsets may be necessary in this and the other equations depending upon the resolution and signal format of devices 314, 410, 320 and 118. In a preferred embodiment, controller 312 is configured to calculate this value Y by combining the weight signal and the volume signal and transmit this value over lines 324 to controller 200 as a signal indicative of bulk density 112.

Figure 7:
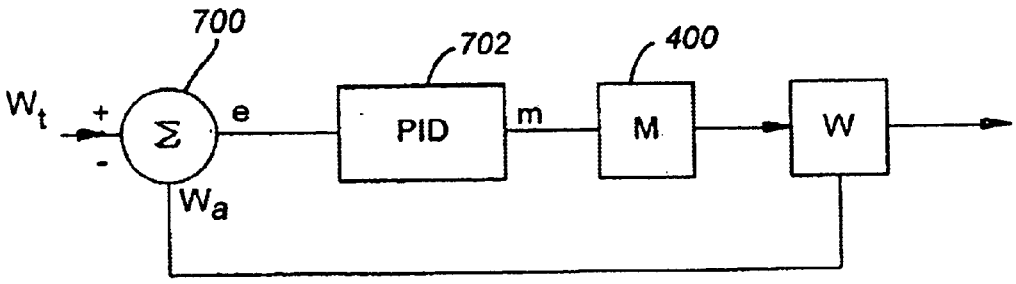
FIG. 7 illustrates the steps executed by the electronic controller of the volumetric metering apparatus in an embodiment of the system in which the electronic controller maintains the weight of each portion of particulate food matter constant by varying the volume.

In a preferred embodiment, controller 312 includes a control algorithm that is configured to maintain the weight of each portion of food constant. As I noted in the background of this invention, it is quite important with food products to meter a precise weight of food material into each individually wrapped package of food. FIG. 7 illustrates this control process performed by controller 312 to maintain the weight of each portion constant. In FIG. 7, a target weight $W_t$ is stored electrically in controller 312. Controller 312 compares this target weight with the actual weight in summation block 700. From this comparison an error signal (e) is generated. Controller 312 is programmed with a control algorithm indicated by block 702, preferably a PID control algorithm, which uses this error signal to generate a motor drive signal (m). This motor drive signal is applied to motor 400, causing the volume of cups 304 to change. By changing the volume of the cups 304, the weight of subsequently measured volumes of particulate food matter by either of devices 410, 320, 118 is changed. This actual weight ("$W_a$") is received by controller 312, which feeds it back to the summation block 700 to begin the control loop all over again. While this is a preferred embodiment of a feedback control algorithm implemented in controller 312 and used to maintain the weight of each measured portion constant, other feedback control algorithms such as a PD or PI algorithm, for example, may be suitable depending upon the speed of response of the system.

Since varying the position of the motor 400 controls the weight, the rotational commands transmitted to the motor 400 to make it move to a predetermined position that will minimize the weight error can be combined with the existing motor position to determine the new position of the motor. For example, if motor 400 is a stepper motor or servomotor, the signal provided to motor 400 is typically going to be the amount of rotation expressed a number of revolutions through which the motor should be rotated to raise and lower bottom plate 302. In either case, controller 312 can, as each correction to the motor position is received, sum these corrections to determine the current position of the motor 400 at any time. Since each motor position corresponds to a particular volume of each of cups 304, the motor position is indicative of the cup volume. Furthermore, since the control algorithm shown in FIG. 7 that is executed by controller 312 maintains the weight of each portion of particulate food matter constant, by minimizing the error signal "e", the motor position is inversely related to the bulk density of the metered portion of particulate food matter that is being weighed. The equation that expresses this relationship is:

$$Y=M(1/M_p)+B$$

Where Y is bulk density, M is a constant, $M_p$ is motor position and B is another constant.

In other words, the greater the motor position measured as an angle or a series of pulses, the greater the volume of the cups. Since the weight is controlled by controller 312 to be constant, it is not a factor in this equation. Only the motor position signal, "$M_p$" determines the volume and hence the bulk density of the particulate food matter. Thus, when the weight is held constant by controller 312, the motor position (or more generally the position of the bottom plate with respect to the top plate) is indicative of the bulk density of the particulate food matter. Y is preferably calculated by controller 312 and sent to controller 200 as a signal indicative of bulk density 112. This step is represented by block 604 of FIG. 6.

Stepper motors are inclined to slip. In other words, when motor drive signals are applied to stepper motors they occasionally do not rotate the desired or commanded amount. As a result, relying on the motor position as provided by the motor drive circuit or by maintaining a motor position counter that is the sum of all the motor position drive commands, may not provide an accurate indication of the motor position. In these cases, it is particularly beneficial to provide an independent motor position sensor such as a shaft encoder that is fixed to the motor to rotate with the motor. This shaft absolute encoder will provide a series of pulses with each increment of motor 400 rotation that can be counted and the rotational position of the motor (hence the volume of cups 304) can be determined. Alternatively, the motor can be driven in an open/loop fashion to maintain the weight constant and the signal from device 314 or any similar device that provides an indication of the position of the top plate 306 with respect to the bottom plate 302, such as a Temposonics position sensor, can be used as a direct indication of the current volume of the cups 304.

In step 606, shown in FIG. 6, controller 312 transmits the signal or signals indicative of bulk density 112 to the food processing machinery 100 (i.e., controller 200). Since bulk density can be indicated either by weight data (when volume is held constant) or by volume (when weight is held constant) or by both volume and weight data (when both vary simultaneously) any one of these signals can be provided by controller 312 to controller 200 of the food processing machinery 100. In the preferred embodiment, controller 312 provides all three values to controller 200 over communication lines 324. These three signals include the weight data provided by devices 410, 320 or 118, the volume data provided by device 314 (or volume data derived from the rotational commands sent to motor 400, or from a shaft encoder configured to rotate with motor 400), and a combined volume and weight signal that is based upon the weight signal divided by the volume signal or reciprocal thereof. Of course, these values can be scaled or inverted, or additional correction factors combined with them in order to compensate for particular signal levels or formats provided by a position sensing device 314, such as the Temposonics position sensor. In addition, controller 312 can provide discrete values, or it can provide moving averages of any of these foregoing values based upon the average bulk density of several successive weighed portions (re cupfuls) of particulate food matter based upon the weight and/or volume of a single portion (cupful) of metered particulate food material.

Figure 8:
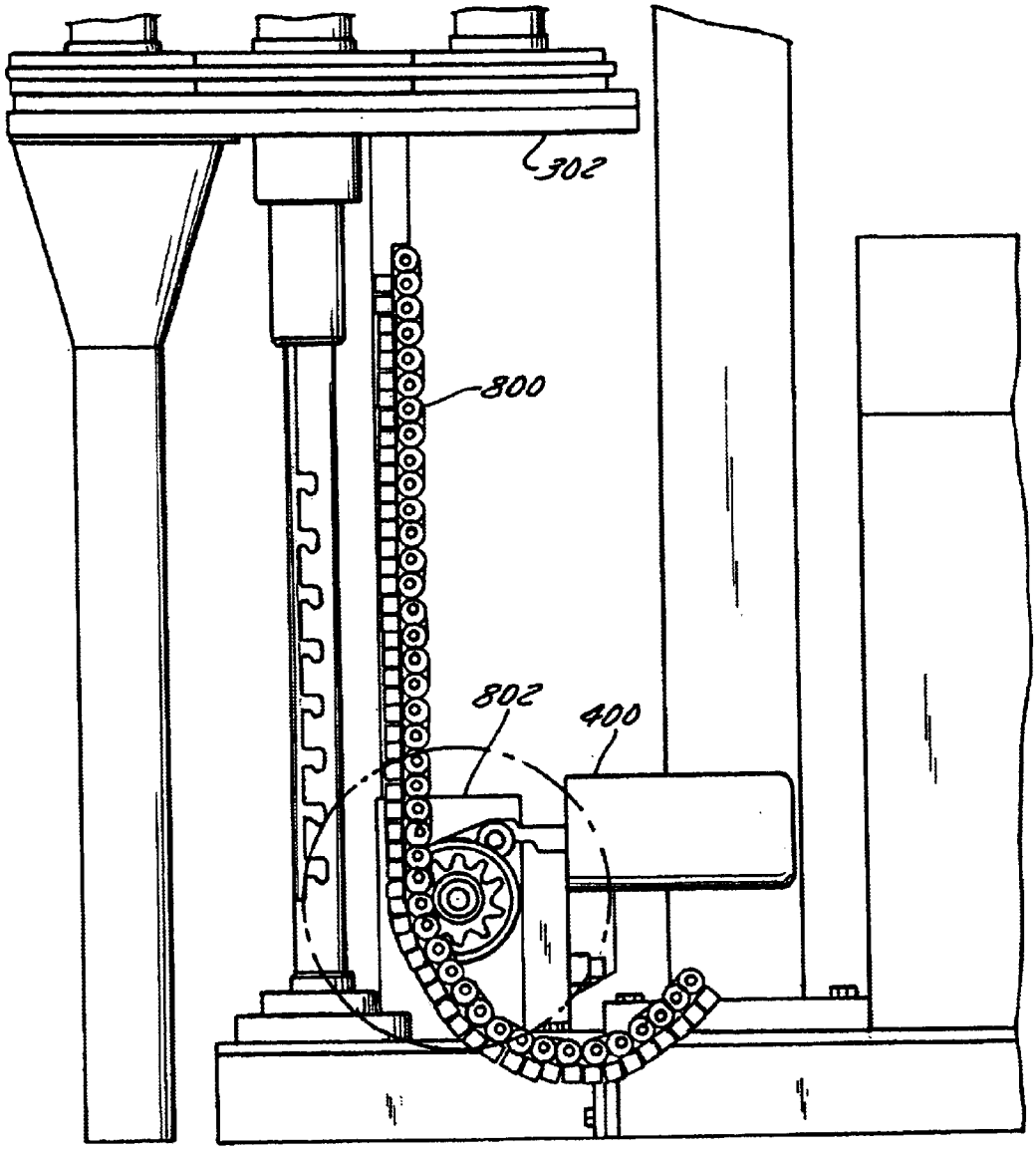
FIG. 8 illustrates an alternative embodiment of the cup filler of FIGS. 3–5 in which the actuator and motor of FIG. 3 has been replaced with a rigid chain drive for raising and lowering the bottom plate with respect to the top plate.
Figure 9B:
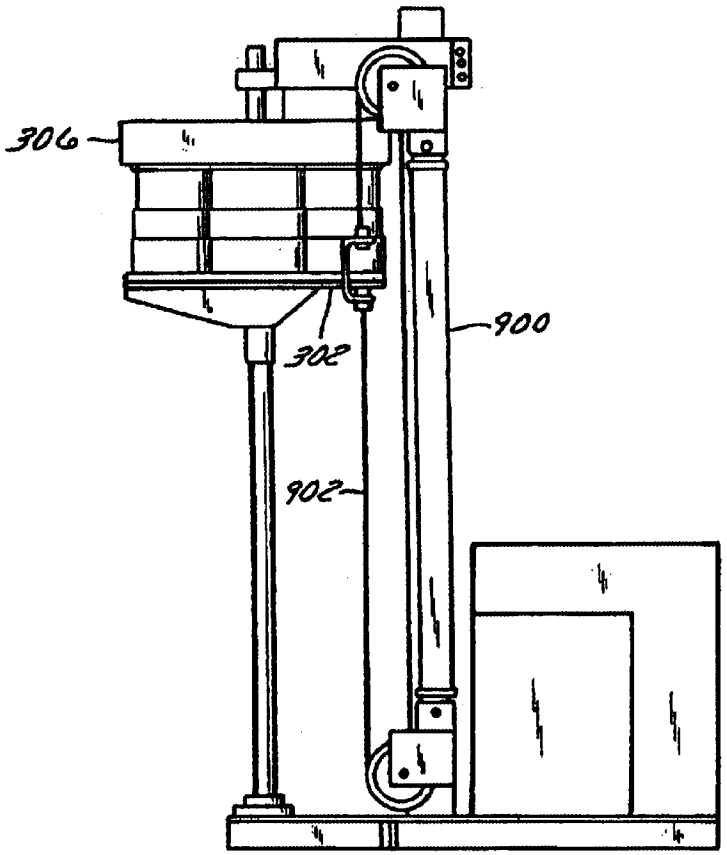
FIGS. 9A and 9B show a partial alternative embodiment of the cup filler in which the actuator of FIG. 3 has been replaced with a cable cylinder that is fixed to the bottom plate to move the bottom plate with respect to the top plate.
Figure 9A:
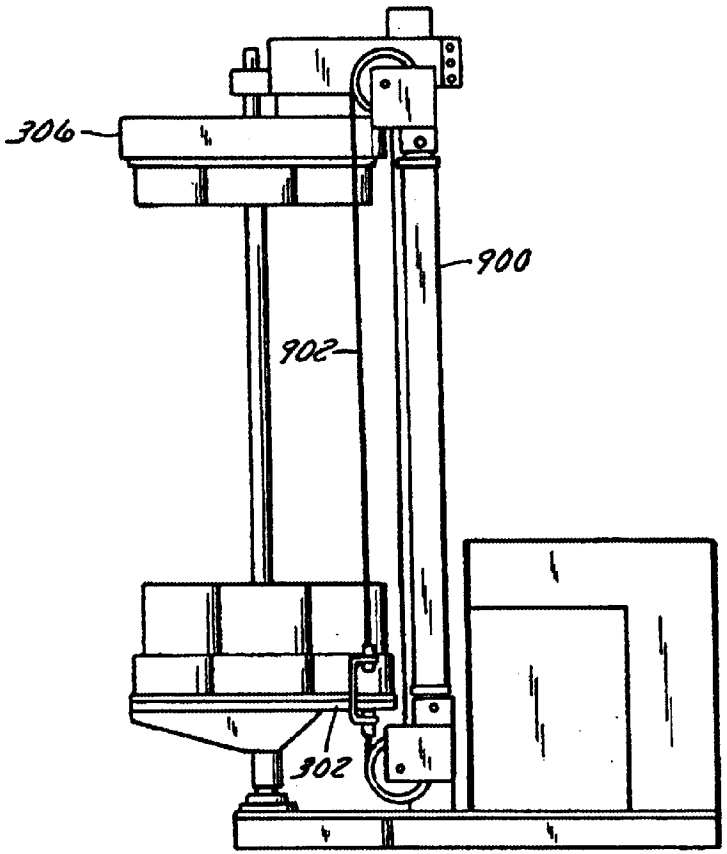
Figure 10A:
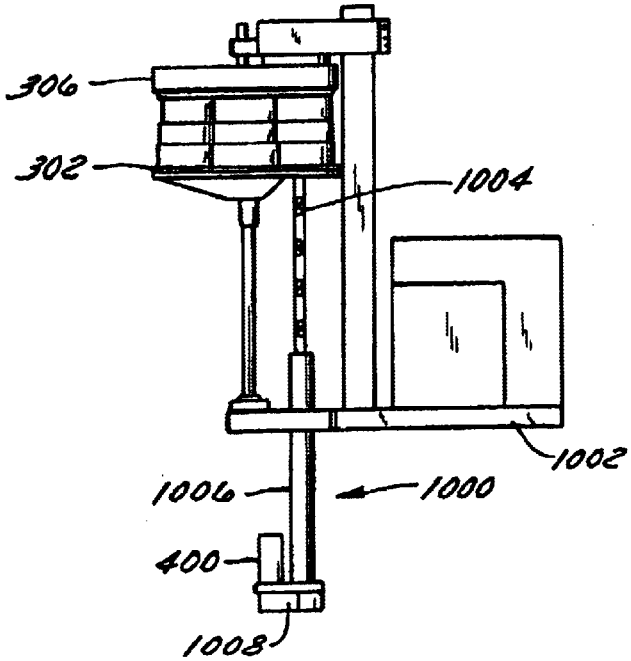
FIGS. 10A and 10B illustrate yet another alternative drive mechanism for raising the bottom plate with respect to the top plate of the cup filler, the drive mechanism comprised of an electric cylinder with a motor driven rod that is coupled to the bottom plate to raise it and lower it with respect to the top plate.
Figure 10B:
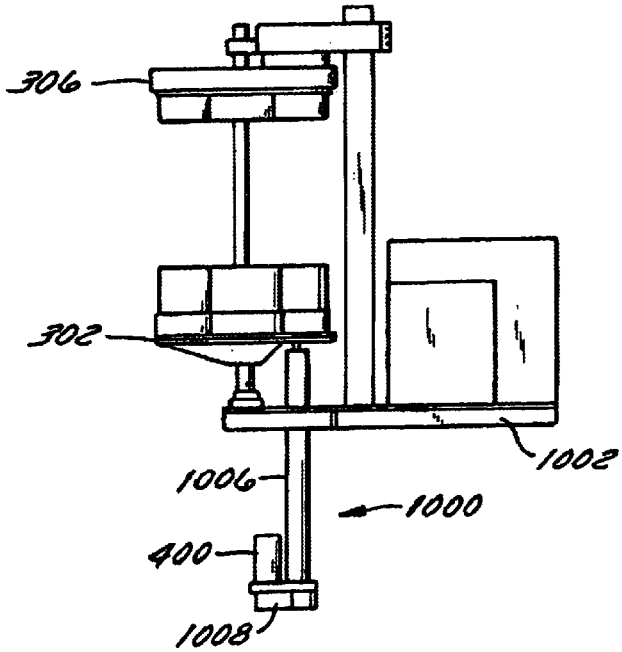

In the description of the cup filler including its controller 312, particular components were described. Different components that provide the same capabilities may be substituted in the invention to provide the same capability, but with alternative structures. For example, rather than the threaded cylinder arrangement provided to drive bottom plate 302 up and down, a jack can be provided. This jack may be a hydraulic jack, a scissors jack, a pneumatic jack, or a motor driven ball-screw jack. In addition, motor 400 may be a servomotor, a stepper motor or a conventional DC or AC motor. Bottom plate 302 may be raised and lowered by a cable cylinder, such as that manufactured by Greenco or by a rigid chain driven by motor 400, such as that manufactured by Serapid. Alternatively, a linear actuator, such as any of the actuators in the Rexroth Star would also be applicable. FIG. 8 illustrates a rigid chain drive 800 driven by motor 400 through reduction gear box 802. This would replace cylinders 402 and 404 (FIG. 4). FIG. 9 illustrates a Greenco cable cylinder including a cable 702 fixed to bottom plate 302. When the Greenco cable cylinder is driven, it moves cable 902 up and down with respect to top plate 306. In FIG. 9, two views of the cup filler are shown, in FIG. 9A, the bottom plate 302 is in a lowered position, and in FIG. 9B the bottom plate 302 is in a raised position FIGS. 10A and 10B illustrate yet another means of raising and lowering the bottom plate 302 with respect to top plate 306. In this embodiment, rather than cylinders 402 and 404, a linear actuator 1000 is provided that is fixed to a lower stationary portion 1002 of the cup filler and includes an extendable rod 1004 that is driven upward and downward with respect to housing 1006. Motor 400 is coupled to a ball-screw or Acme threaded member (not shown) inside housing 1006 that engages with member 1004 to raise it and lower it with respect to stationary portion 1002. The upper end of member 1004 is engaged with the bottom of bottom plate 302, thus raising and lowering it with respect to top plate 306 whenever motor 400 is driven. Housing 1008 at the lower end of actuator 1000 covers either gears or belts that engage motor 400 to the servo ball-screw or Acme threaded member disposed inside housing 1006. In this manner, rotation of motor, which is coupled to the ball screw, 400 causes member 1004 to raise and lower, thus raising and lowering bottom plate 302 with respect to top plate 306.

The other components of the cup filler have been removed in FIGS. 8–10 for better illustration of the different actuators that may be used in place of the cylinders 402 and 404. Controller 312 and controller 200 are preferably programmable logic controllers or PLC's; such as the Automation Direct brand PLC, which is manufactured by Koyo, and preferably the D405 series, the D305 series, or the D205 series. Alternatively, an Allen-Bradley PLC from the SLC series or ControlLogix series, or MicroLogix series is also suitable. The Siemens 505 series or S-7 series PLC's are suitable, as is Modicon Quantum series PLC. Alternatively controller 312 and controller 200 may be industrial PC's.

The signals exchanged between controller 312 and controller 200 over communications lines 324 may be in the form of an analog voltage or current signal, or a digital signal following the RS232, RS422 or RS485 ASCII communications protocol. Alternatively, circuit 328 may be configured to communicate over lines 324 to controller 200 using the Allen-Bradley DF1 DH45 protocol, the DH Plus protocol, DeviceNet, Control net, RIO, or Ethernet. If a Automation Direct brand PLC is used, the preferred communications protocol is Direct Net, K-Sequence, Ethernet, Profibus, DeviceNet, or MODBUS. The signals indicative of the bulk density, (whether an expression of volume, weight, or a combination of volume and weight), are preferably not only digital signals, but are packetized in digital packets of predetermined lengths. Of course, other PLC's use other protocols that may be equally applicable to the system.

Controller 312 is configured to transmit the data in a first "direct" mode or a second "polled" mode of operation. In the direct mode of operation, controller 312 transmits one or all of the signals indicative of bulk density at predetermined time intervals, typically every ten (10) to fifty (50) milliseconds. In the direct mode, this is done without prompting by any other device connected to communication lines 324. In the polled mode of operation, controller 312 is configured to receive a predetermined packet of digital information from controller 200 indicative of a request for bulk density data. In response to this, controller 312 is configured to packetize the latest signals indicative of bulk density and to transmit them to controller 200 over communication lines 324 including signals based on weight, on volume, and on combined weight and volume. The polled mode of operation reduces data congestion on communication lines 324. Alternatively, controller 312 is configured to operate in a combined mode of operation in which the signals indicative of bulk density are transmitted at a predetermined interval yet controller 312 will also respond to queries for information from other devices on signal lines 324 (such as controller 200) by packetzing and transmitting specifically requested bulk density data as described above in the polled mode of operation.

Referring back to FIG. 2, electronic controller 200 is electrically connected to controller 312 as indicated by item 202 which shows the communications line over which electronic controller 200 receives the signal indicative of bulk density from electronic controller 312. As described above, this data can be in analog form, although it is preferably in digital form and preferably packetized in discrete packets of fixed length. Electronic controller 200 is configured to control each food processing device 202–230 in accordance with the operating parameters identified in the patents and text identified above for producing ready-to-eat cereal. In the patents identified above, particular operating parameters, such as temperatures, pressures and speeds of processing for various ones of these devices 202–230 are described in greater detail. These operating parameters, and the methods of controlling them using PLC's or other electronic controllers are well known in the art. As identified above, many of them can be purchased, including their all-ready programmed PLC's from numerous product manufacturers. By changing any of the operational parameters controllable by machinery items 202–230, the bulk density of the particulate food matter can be changed. For example, by changing the speed of agitation and mixing, or the temperature of the materials that are agitated and mixed, or the length of time the materials are agitated or mixed in device 204, the bulk density of the particulate food matter will be varied. By changing the speed or temperature at which any of the extruders 208, 212, or 214 operate, the bulk density of the particular food matter can also be varied. By changing the size of each pellet of food matter produced by pelletizing extruder 214 such as by speeding up the extruder screws, or speeding up the knife blade that slices off the pellets, or slowing it down, the bulk density of the particulate food matter can also be changed. Changing the roll spacing or force or temperature of either of flaking rolls 220 or shredding rolls 222 will similarly change the size and shape of the flaked or shredded material and therefore also change the bulk density of the particulate food matter. In a similar fashion, changing the temperature of operation of any of ovens 216, 218, 228 or 230, or changing the speed at which material is conveyed through those ovens, such as by varying the power output by the microwave generator or the temperature inside the oven by varying the power to heating elements, will also change the way the particulate food matter or raw dough is treated and therefore also change the bulk density of the particulate food matter. Varying the rate at which coatings are emitted from the enrober 202 that are applied to each of the particles of the particulate food matter will change their weight and hence also change the bulk density of the particulate food matter so enrobed.

In short, changing any of the operational parameters of items 202–230 changes the bulk density of the particulate food matter. No specific bulk density, and hence no specific operational parameter is claimed in this application. Such a specific bulk density would only be applicable to a particular food item or desired texture or bulk density. Any specific recipe or set of processing parameters used to produce particulate food matter forms no part of this invention.

Figure 11:
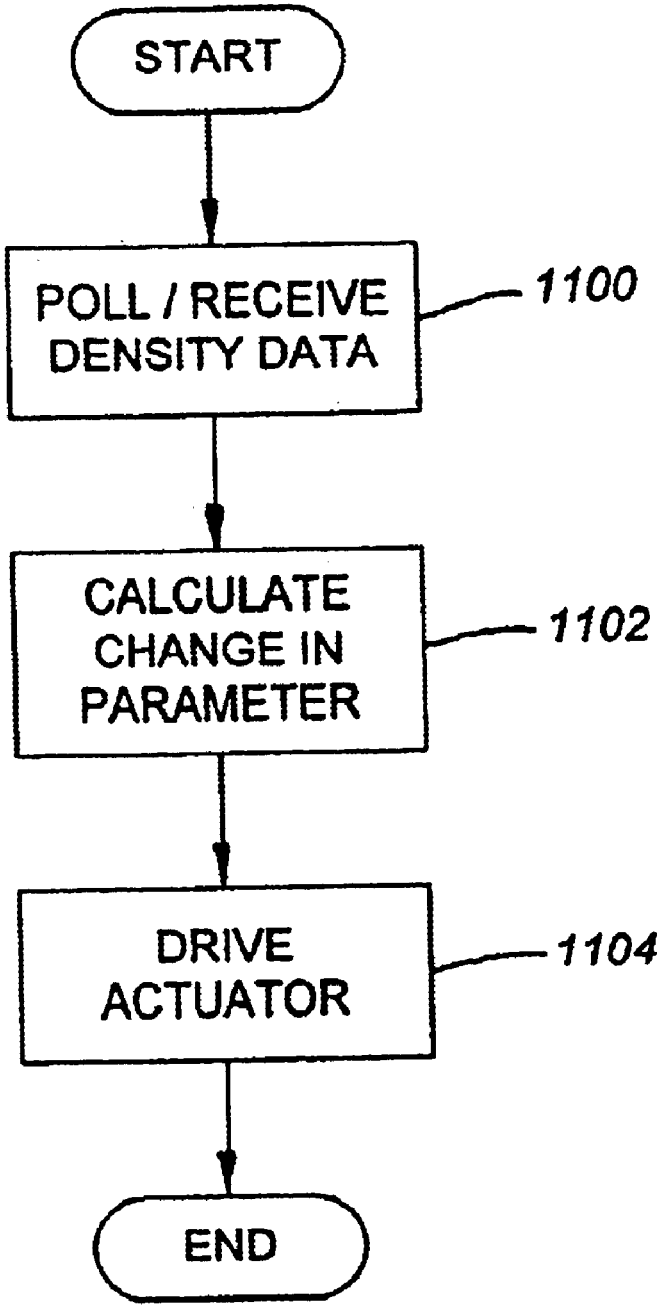
FIG. 11 is a flow chart of steps performed by electronic controller 200 when it changes operating parameters of any of the food processing machinery illustrated in response to the signal indicative of bulk density received from controller 312.

FIG. 11 is a block diagram of a portion of the programming performed by electronic controller 200. The program represented by this block diagram is stored in an electronic memory inside electronic controller 200 and is executed periodically, preferably on an interval of between 10 and 100 milliseconds to alter the bulk density of the particulate food matter in response to the signal indicative of bulk density received from controller 312. In step 1100, electronic controller 200 receives density data, i.e., the signal or signals indicative of bulk density from controller 312. This data can be received automatically, if controller 312 is operating in its direct mode. If controller 312 is operating in its pulled or combined modes of operation, controller 200 in step 1100 transmits a request for the signals indicative of bulk density, then receives those signals when controller 312 transmits them in response to the request. In step 1102, controller 200 calculates the appropriate change in the operational parameters of the food processing devices 204–230. Again, this calculation is performed by controller 200 based upon the numeric data received from controller 312 that is indicative of bulk density. An illustrative example of a parameter that can be changed is the size of the flakes produced by flaking rolls 220. The size of the flakes is a function of the spacing of the flaking rolls, which in turn is varied by varying the force applied to the rolls or the spacing of the rolls. If the rolls are forced together more tightly for a predetermined size of pellet, they will increase the size of the flake and thus change the bulk density. If the size of the pellets is changed, such as by varying the speed of the extruder or the rotating knife that cuts off the pellets from the extruder, this change the volume of each pellet that is flaked and therefore when the pellet is inserted into the flaking rolls 220, it will change the size of the flake, and thus change the bulk density. The appropriate change in the operational parameters of the food processing machinery is then initiated by the drive actuator 1104.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims.

For example, some cup fillers vary the volumes of their cups not by moving a bottom plate up and down and holding a top plate stationary, but by moving the top plate up and down and holding the bottom plate stationary. In such a cup filler, rather than determining the distance between the top plate and the bottom plate by monitoring the changing position or motion of the bottom plate, one would instead monitor the changing position or motion of the top plate using a sensor such as device 314.

What is claimed is:

1. A system for manufacturing particulate food matter and changing the bulk density thereof, comprising:

a cup filler including;

a plurality of cups each having a variable volumetric capacity and fixed to rotate about a common rotational axis, each cup defining a volumetrically metered portion of particulate food matter;

a planar bottom plate disposed to support a lower portion of each of the cups and configured to change the volume of the cups;

a top plate disposed to support an upper portion of each of the cups;

a position sensor disposed to sense changes in the volume of each cup and to generate an electrical signal indicative of such volumetric changes;

a weight sensing device for determining a weight measurement of the volumetrically metered portions of particulate food matter;

a first electronic controller coupled to the position sensor and to the weight sensing device to generate a series of electrical signals indicative of the bulk density of the volumetrically metered portions;

a second electronic controller coupled to the first electronic controller over first communications lines to receive the series of electrical signals indicative of bulk density; and at least one food processing device selected from the group consisting of a mixer-agitator, a pre-conditioner, a cooling extruder, a batch steam cooker, a forming and cooking extruder, a pelletizing extruder, a microwave oven, a tempering oven, flaking rolls, shredding rolls, a deep-fat fryer, a gun puffer, a toasting oven, a baking oven and an enrober, the device having at least one electrically controllable actuator configured to regulate at least one machine operating parameter;

wherein the second electronic controller is configured to change the operating parameter based upon at least one signal in the series of electrical signals indicative of bulk density by electrically signaling the at least one electrically controllable actuator, and further wherein the change in that electrically controllable actuator varies the bulk density of the particulate food matter.

2. The system of claim 1, wherein said weight sensing device comprises:

a weigh bucket disposed beneath the cups to receive and successfully contain a series of the volumetrically metered portions; and a weight sensor coupled to the weigh bucket to successively weigh the series of the volumetrically metered portions and to generate a corresponding series of electrical weight signals indicative of the weight of the volumetrically metered portions.

3. The system of claim 1, wherein said weight sensing device comprises:

a checkweigher positioned downstream in relation to food particulate processing for successively weighing a series of food particulate packages through use of a weight sensor to obtain weight values, for comparing weight values obtained to a pre-programmed reference weight, and for generating an electrical signal indicative of said food particulate packages.

4. The system of claim 1, wherein said weight sensing device comprises:

a centripetal force meter.

5. The system of claim 2 further comprising:

a checkweigher positioned downstream in relation to food particulate processing, for successively weighing the food particulate packages through use of a second weight sensor to obtain weight values, for comparing weight values obtained to a pre-programmed reference weight, and for generating an electrical signal indicative of the weight of said packaged food particulate.

6. The system of claim 1, wherein the first controller is configured to maintain the weight of each portion constant by responsively changing the volume of the cups and to generate and transmit to the second controller an electrical signal indicative of the changed volume of each portion.

7. The system of claim 1, wherein the position sensor is an ultrasonic sensor.

8. The system of claim 1, wherein the position sensor utilizes magneto restriction.

9. The system of claim 1 or 4, wherein the first controller is a device selected from the group consisting of a PLC and a PC.

10. The system of claim 5, wherein the second controller is a device selected from a group consisting of a PLC and a PC.

11. The system of claim 4, wherein the cup filler further includes an electrically-driven actuator mechanically coupled to the cups to change the volume thereof.

12. The system of claim 11, wherein the electrically-driven actuator is attached to the bottom plate to move the bottom plate with respect to the top plate.

13. The system of claim 12, wherein the electrically-driven actuator includes an electrical motor electrically connected to the first controller and the first controller is configured to drive the electrically driven actuator to vary the volume of the cups in response to the weight signals.

14. The system of claim 13, wherein the cup filler further includes a vertical shaft that is coupled to the cups to rotate the cups about their common rotational axis and further wherein the electrically driven actuator includes a pair of coaxial cylinders threadedly engaged to one another and disposed about the vertical shaft.

15. A control system for controlling food processing machinery using a signal indicative of bulk density, comprising:

a cup filler including a plurality of cups that rotate about a common rotational axis, a motor that drives the cups about their axis, a weight sensor that measures the weight of the contents of the cups, and a volume sensor to provide a signal indicating the volume of the cups;

a first controller coupled to the weight and volume sensors to receive weight and volume signals from the weight and volume sensors and to generate at least one signal indicative of the bulk density of contents contained within the cups; and a second controller in electrical communication with the first controller to receive the at least one signal indicative of the bulk density of the cups and to generate a machine control signal for the food processing machinery selected from the group consisting of a mixer-agitator, a pre-conditioner, a forming and cooking extruder, a cooking extruder, a batch steam cooker, a pelletizing extruder, a microwave oven, a tempering oven, flaking rolls, shredding rolls, a deep-fat fryer, a gun puffer, a toasting oven, a baking oven and an extruder.

16. The system of claim 15, wherein the machine control signal is a motor speed signal and the food processing device includes an electrical motor responsive to the motor speed signal and is selected from the group consisting of the mixer-agitator, the batch steam cooker, an extruder, flaking rolls or shredding rolls.

17. The system of claim 15, wherein first and second controllers are a device selected from the group consisting of a PLC and a PC.

18. A method of controlling the bulk density of particulate food matter, comprising the steps of:

processing raw materials in a plurality of food processing devices, having respective operational parameters, into a continuous stream of particulate food matter;

volumetrically metering the continuous stream of particulate food matter into a series of individual portions of particulate food matter;

sequentially weighing each individual portion in the series of individual portions;

generating an electrical signal indicative of the bulk density of the series of individual portions; and varying at least one of the operational parameters of the food processing devices in response to the signal indicative of bulk density.

19. The method of claim 18, further comprising the step of electrically transmitting the electrical signal indicative of bulk density from a first electronic controller to a second electronic controller.

20. The method of claim 19, wherein the step of varying operational parameters includes the steps of:

deriving an actuator command signal in the second electronic controller based upon the electrical signal indicative of bulk density; and applying the actuator command signal to an actuator on the food processing devices.

21. The method of claim 20, further comprising the steps of:

modifying the bulk density of the particulate food matter in response to application of the actuator signal to the actuator.

* * * * *